US010144578B2

(12) United States Patent
Chen et al.

(10) Patent No.: US 10,144,578 B2
(45) Date of Patent: Dec. 4, 2018

(54) BICYCLE PACKAGING STRUCTURE

(71) Applicant: GIANT MANUFACTURING CO., LTD., Taichung (TW)

(72) Inventors: Tsung-Lung Chen, Taichung (TW); Jiun-Hung Chung, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 0 days.

(21) Appl. No.: 15/459,606

(22) Filed: Mar. 15, 2017

(65) Prior Publication Data

US 2018/0093819 A1 Apr. 5, 2018

(30) Foreign Application Priority Data

Oct. 4, 2016 (TW) ..... 105132051 A

(51) Int. Cl.

| | |
|---|---|
| ***B65D 85/68*** | (2006.01) |
| ***B65D 25/10*** | (2006.01) |
| *B65D 5/50* | (2006.01) |
| *B65D 5/52* | (2006.01) |

(52) U.S. Cl.

CPC ..... *B65D 85/68* (2013.01); *B65D 25/10* (2013.01); *B65D 5/5035* (2013.01); *B65D 5/5042* (2013.01); *B65D 5/52* (2013.01); *B65D 2585/6862* (2013.01)

(58) Field of Classification Search

CPC ..... B65D 85/68; B65D 25/10; B65D 2585/6862; B65D 5/5052; B65D 5/5035; B65D 5/52; B65D 5/5042

USPC ..... 206/335, 736, 763, 765, 730, 733, 734, 206/731, 448; 220/6, 7; 152/375; 229/103.2

See application file for complete search history.

(56) References Cited

U.S. PATENT DOCUMENTS

| | | | | |
|---|---|---|---|---|
| 2,339,947 A * | 1/1944 | Reaume | B65D 85/68 206/335 |
| 2,490,186 A | 12/1949 | Yarman | |
| 3,929,225 A * | 12/1975 | Locke | B65D 5/5038 206/335 |
| 6,267,237 B1 * | 7/2001 | McNeill | B65D 85/68 206/335 |
| 7,185,762 B2 * | 3/2007 | Ferris | B65D 33/10 206/525 |

(Continued)

*Primary Examiner* — Rafael Ortiz

(74) *Attorney, Agent, or Firm* — Muncy, Geissler, Olds & Lowe, P.C.

(57) ABSTRACT

A bicycle packaging structure for a bicycle including a bicycle frame is provided. The bicycle packaging structure includes an exhibition box and at least one fixing member. The exhibition box includes a lower plate, a side plate surrounding the lower plate, an accommodating space formed by the lower plate and the side plate, and an exhibition opening at one side of the side plate away from the lower plate. The bicycle frame is accommodated in the accommodating space and mounted on the lower plate by the at least one fixing member. Thus, the bicycle frame may be directly exhibited through the exhibition opening and be sold to eliminate conventional complications of box opening and assembly for exhibition and post-exhibition re-boxing. The bicycle frame is placed in the exhibition box for carrying outdoors to achieve objects of recycling and reducing costs and burden on the environment.

13 Claims, 5 Drawing Sheets

(56) References Cited

U.S. PATENT DOCUMENTS

| | | | | |
|---|---|---|---|---|
| 8,881,776 | B2 * | 11/2014 | Waters | B62J 19/00 150/154 |
| 2010/0230311 | A1 * | 9/2010 | Jacques | A45C 11/00 206/335 |
| 2011/0042263 | A1 * | 2/2011 | Kemper | B65D 85/68 206/592 |

* cited by examiner

BICYCLE PACKAGING STRUCTURE

FIELD OF THE INVENTION

The present invention relates to a packaging structure, and particularly to a bicycle packaging structure.

BACKGROUND OF THE INVENTION

With the rising of health awareness, sports have become an essential part of the daily life of modern people. In a busy society, riding bicycles is one top choice among different kind of exercises. Given one bicycle, one can freely travel amidst streets and lanes. Thus, bicycle riding is one popular exercise, in a way that sale volumes of bicycles have also surged significantly. During a transportation process of bicycles, appropriate packaging is required to prevent the vehicles from impacts and damages.

For example, the U.S. Pat. No. 2,490,186 disclose a common transportation method, "Bicycle Package". In the above disclosure, an assembled bicycle is directly boxed, and a plurality of fastening members are provided to secure the wheels to prevent from sliding and collisions. However, by boxing the entire bicycle, the volume of the box is rather too large to be readily transported. On the other hand, if the parts of the bicycle are first disassembled, wrapped in protective materials, boxed and then transported, a servicing staff needs to re-assembled before putting the bicycle for exhibition and sale after the bicycle arrives at a point of sale. Thus, such approach is not only time and effort consuming but also the removed protection materials cannot be easily recycled, hence leading to increased costs and burden on the environment.

Therefore, there is a need for a solution that allows a bicycle to be directly exhibited and sold to reduce assembly time and to recycle packaging materials.

SUMMARY OF THE INVENTION

It is an object of the present invention to overcome issues of additional assembly needed for exhibiting and selling a bicycle, as well as poor packaging quality and unrecyclable packaging materials of a bicycle.

To achieve the above object, the present invention provides a bicycle packaging structure for a bicycle. The bicycle includes at bicycle frame. The bicycle packaging structure includes an exhibition box and at least one fixing member. The exhibition box includes a lower plate, a side plate surrounding the lower plate, an accommodating space formed by the lower plate and the side plate, and an exhibition opening located at one side of the side plate away from the lower plate. The bicycle frame is accommodated in the accommodating space. The lower plate includes a plurality of fixing holes. The at least one fixing member secures the bicycle frame at the lower plate through the fixing holes.

In conclusion, the present invention provides following features.

1. Without an additional assembly process for exhibition, the bicycle frame may be exhibited through the exhibition opening and sold. Thus, post-exhibition disassembling complications can be reduced to save time and to enhance packaging quality.

2. To carry the bicycle outdoors, the bicycle frame may be placed back into the exhibition box for easy carrying, such that the exhibition box may be recycled for repeated use to reduce costs and burden on the environment.

DETAILED DESCRIPTION OF THE PREFERRED EMBODIMENTS

Details and technical contents of the present invention are given with the accompanying drawings below.

Figure 1:
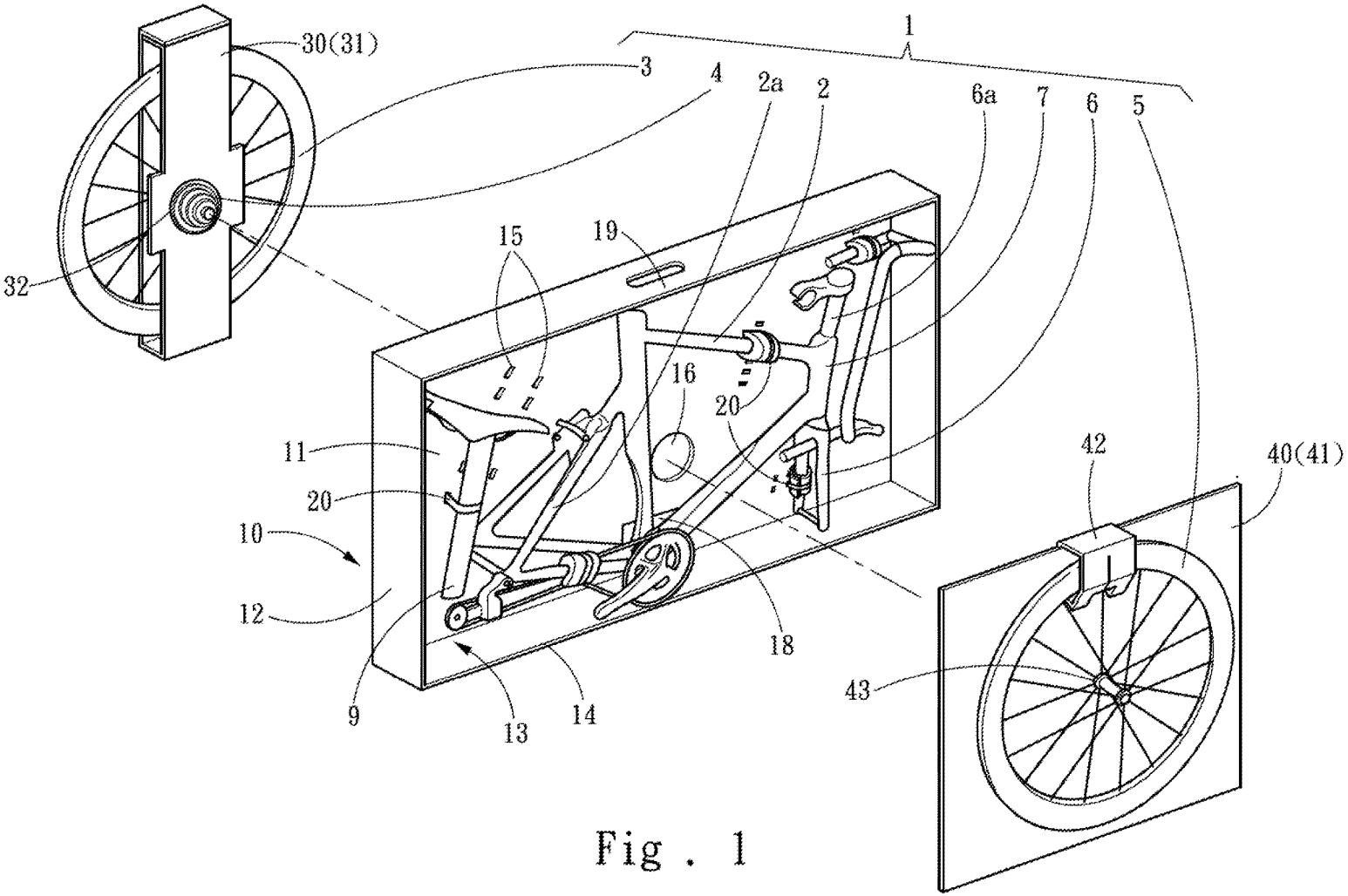
FIG. 1 is an exploded perspective structural schematic diagram according to a first embodiment of the present invention.
Figure 2:
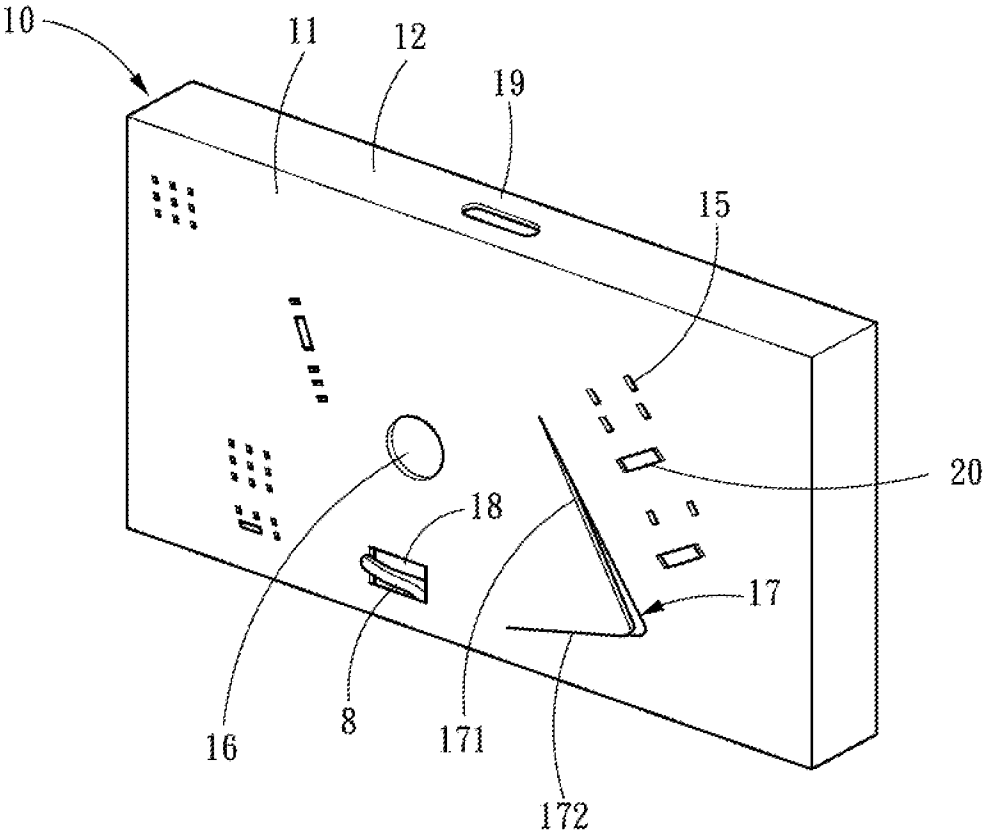
FIG. 2 is a rear perspective schematic diagram of an exhibition box according to the first embodiment of the present invention.

Referring to FIG. 1 and FIG. 2, the present invention provides a bicycle packaging structure for a bicycle. The bicycle 1 includes a bicycle frame 2, a first wheel 3 and a second wheel 5. The bicycle packaging structure includes an exhibition box 10. The exhibition box 10 includes a lower plate 11, a side plate 12, an accommodating space 13, and an exhibition opening 14. The side plate 12 surrounds the lower plate 11. The lower plate 11 and the side plate 12 form the accommodating space 13. The exhibition opening 14 is located at one side of the side plate 12 away from the lower plate 11. The bicycle frame 2 is accommodated in the accommodating space 13 and mounted on the lower plate 11. Thus, without additional assembly processes, the bicycle frame 2 may be exhibited through the exhibition opening 14 and sold to save time. It should be noted that, the bicycle frame 2 in the present invention refers to a main frame of the bicycle 1, and a handle and a seat of the bicycle 1 may be together selectively placed in the exhibition box 10 with consideration of actual needs.

In the embodiment, the bicycle packaging structure further includes at least one fixing member 20, and the lower plate 11 includes a plurality of fixing holes 15 and a crank fixing hole 18. The at least one fixing member 20 mounts the bicycle frame 2 on the lower plate 11 though the fixing holes 15. Further, a seat post 9 of the bicycle frame 2 is similarly mounted on the lower plate 11 by penetrating the at least one fixing member 20 through the fixing holes, and a vertical bar 6*a* of a front fork 6 is inserted into a head tube 7 of the bicycle frame 2 through the fixing holes 15, and is similarly secured at the lower plate 11 by penetrating the at least one fixing member 20 through the fixing holes 15. Further, a crank 8 of the bicycle frame 2 is penetrated and secured at the crank fixing hole 18. Thus, the bicycle frame 2 is secured to prevent sliding movements from impacting and scratching the bicycle frame 2 during a transportation process.

Figure 3:
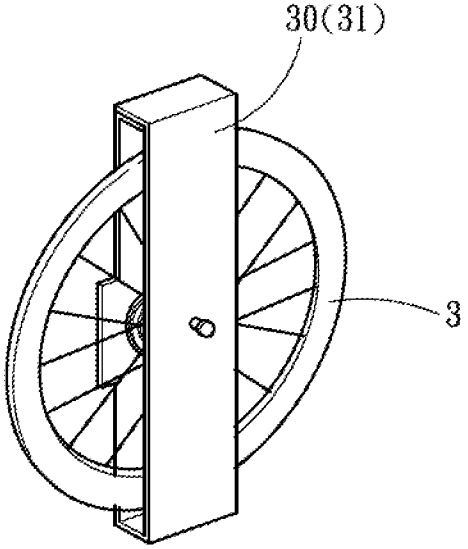
FIG. 3 is a rear perspective schematic diagram of a packaged first wheel according to the first embodiment of the present invention.

Referring to FIG. 2 and FIG. 3, the lower plate 11 further includes a positioning opening 16. The positioning opening 16 corresponds to a position of a wheel axis of the first wheel 3, such that the wheel axis of the first wheel 3 may be positioned on the positioning opening 16, and the first wheel 3 may be disposed at one side of the lower plate 11 away from the accommodating space 13. In this embodiment, the bicycle packaging structure further includes a wheel positioning member 30 disposed at one side of the lower plate 11 away from the accommodating space 13. The wheel positioning member 30 includes a protection body 31 that secures the first wheel 3 and a first through hole 32 for the wheel axis of the first wheel 3 to pass through. Thus, the wheel axis of the first wheel 3 first passes through the first through hole 32 and is then positioned on the positioning opening 16. The first wheel 3 may be a rear wheel of the bicycle 1, and includes a transmission gear assembly 4 coaxial as the wheel axis of the first wheel 3. The transmission gear assembly 4 may penetrate the first through hole 32 and be positioned on the positioning opening 16. In the present embodiment, the transmission gear assembly 4 penetrates the positioning opening 16 and be positioned in the accommodating space 13. With the positioning opening 16, the first wheel 3 may be fastened on the lower plate 11, and the wheel positioning member 30 is capable of protecting and securing the first wheel 3, so as to prevent the first wheel 3 from impacts during a transportation process.

Figure 4:
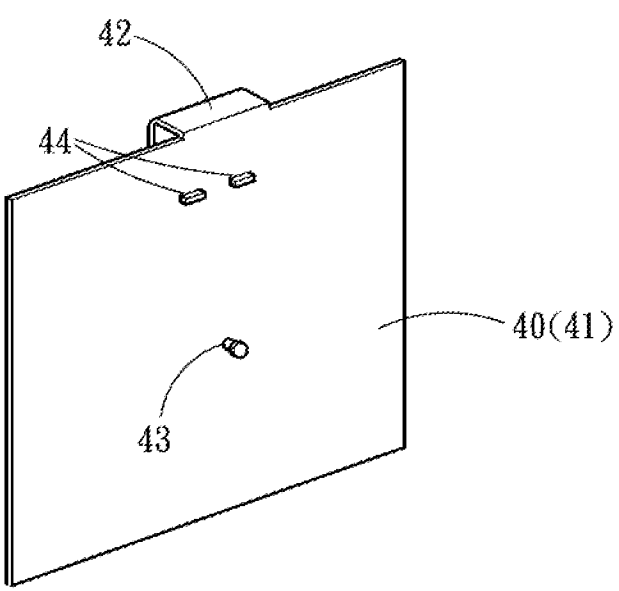
FIG. 4 is a rear perspective schematic diagram of a packaged second wheel according to the first embodiment of the present invention.

Referring to FIG. 4, the present invention further includes a protective separating member 40. The protective separating member 40, adjacent to the exhibition opening 14 and for installing the second wheel 5 of the bicycle 1, includes a protective partitioning plate 41, a fastening portion 42, a second through hole 43 and a fastening hole 44. A wheel axis of the second wheel 5 is penetrated in the second through hole 43, and is located at one side of the protective partitioning plate 41 away from the bicycle frame 2. The fastening portion 42 fixes the second wheel 5 on the protective partitioning plate 41 through the fastening hole 44. The second wheel 5 may be a front wheel of the bicycle 1. With the protective partitioning plate 41, friction between the second wheel 5 and the bicycle frame 2 can be prevented. With the fastening portion 42, the second through hole 43 and the fastening hole 44, the second wheel 5 may be secured on the protective partitioning plate 41 to prevent damages caused by sliding during a transportation process.

The widest part of the bicycle frame 2 is at a seat stay 2*a*. Thus, the lower plate 11 includes a first cut section 171, and a second cut section 172 that meets and forms an included angle with the first cut section 171. Thus, an upper fork accommodating portion 17 is formed correspondingly to the shape and position of the seat stay 2*a*, such that the seat stay 2*a* may partially pass through the lower plate 11 via the upper fork accommodating portion 17, thereby reducing the boxing volume while avoiding the projected part from interfering the first wheel 3.

Figure 5:
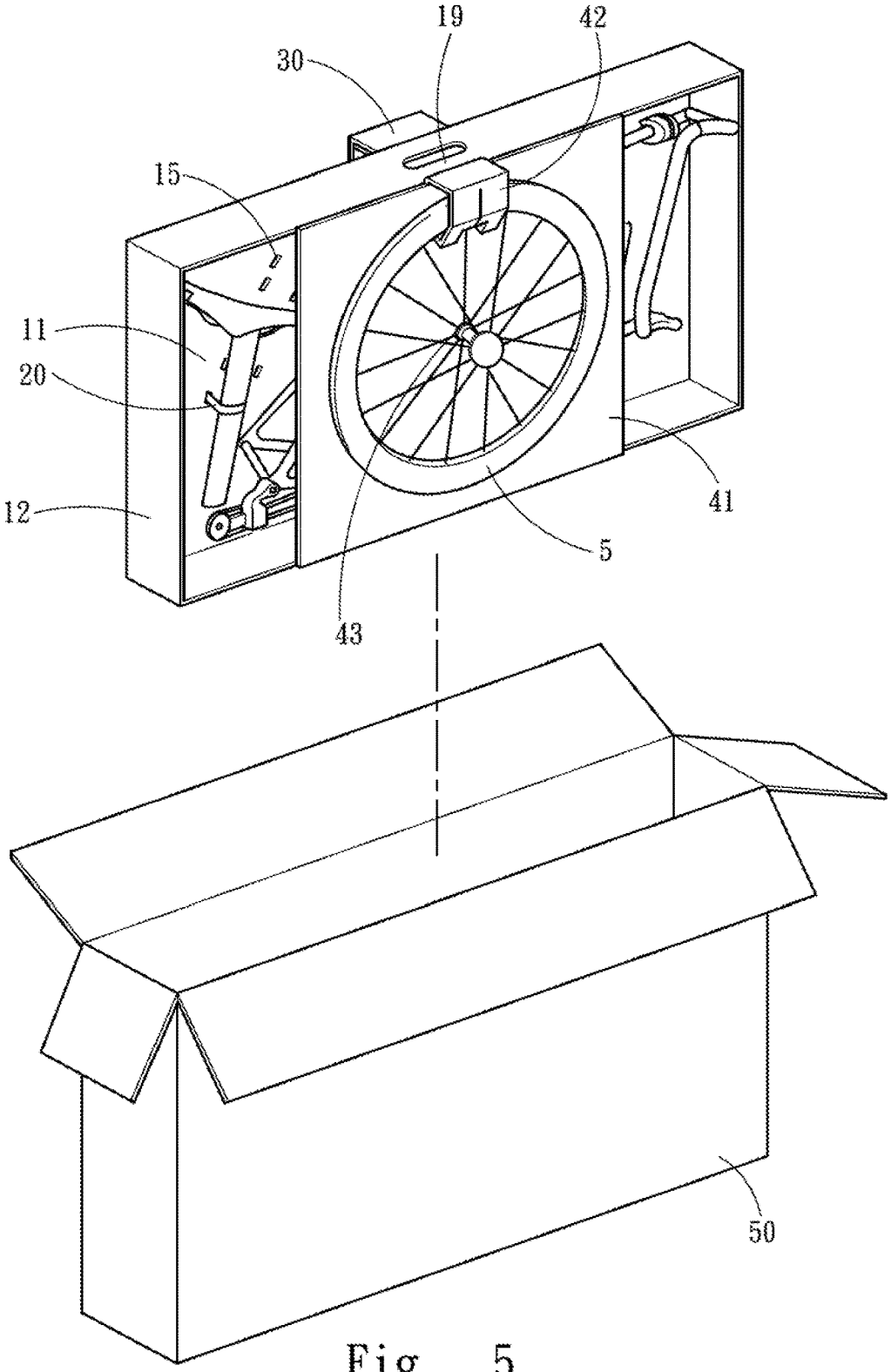
FIG. 5 is a schematic diagram of a boxing state according to the first embodiment of the present invention.

Referring to FIG. 5, during a boxing process, the exhibition box 10 is placed into an outer box 50, and the first wheel 3 and the second wheel 5 that are already packaged and protected are placed into the exhibition box 10. The side plate 12 includes a handle member 19 for carrying. The entire exhibition box 10 can then be easily drawn out using the handle member 19 as desired, and be exhibited at a point of sales without involving an additional assembly process for exhibition, thereby reducing post-exhibition disassembling complications and saving time and effort. To carry outdoors, the bicycle frame 2 is placed back into the exhibition box 10, and is placed together with the first wheel 3 and the second wheel 5 that are already packaged into the outer box 50. Thus, an object of recycling is achieved to reduce costs and burden on the environment.

Figure 6:
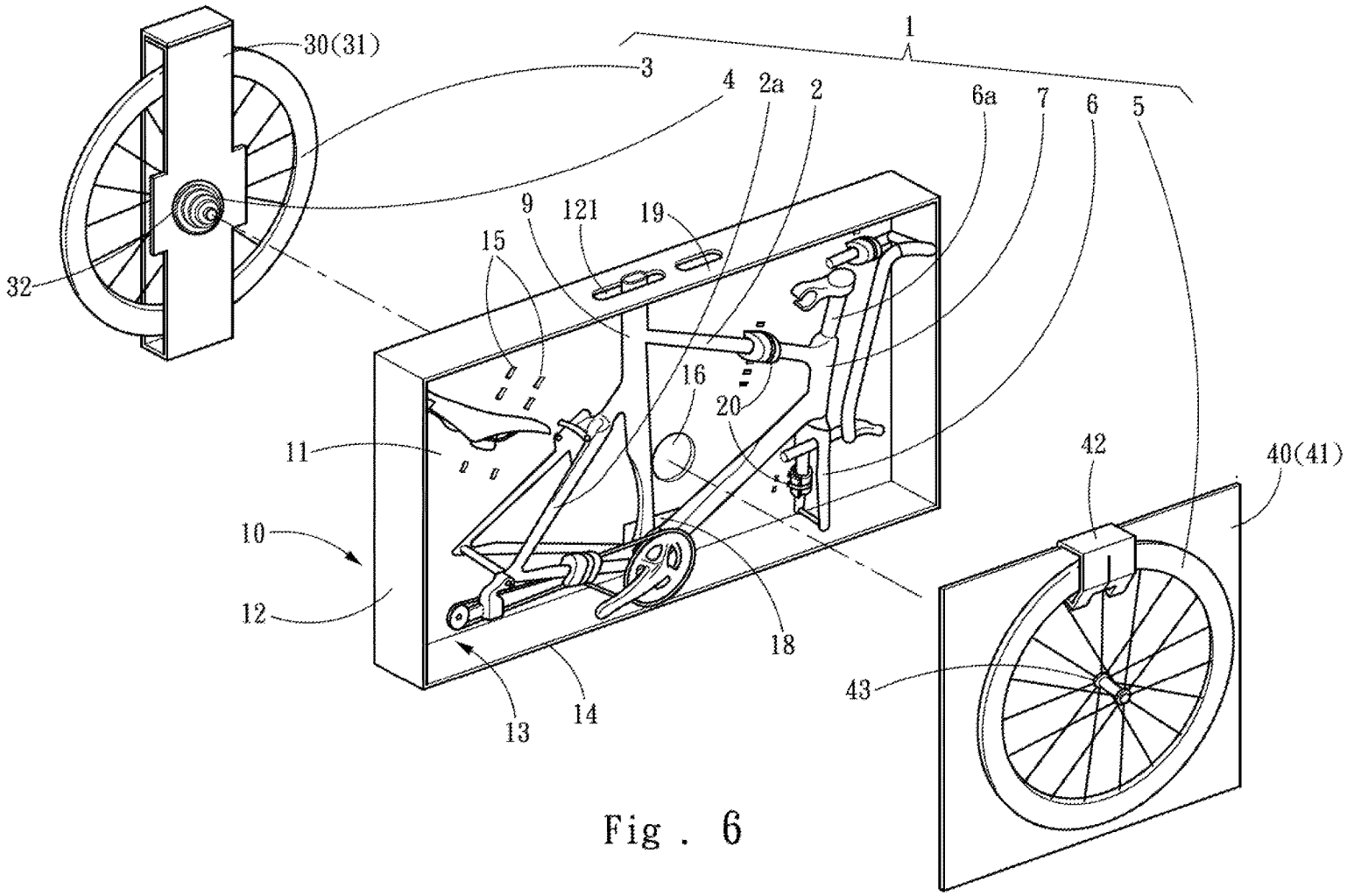
FIG. 6 is an exploded perspective structural schematic diagram according to a second embodiment of the present invention.

Referring to FIG. 6, when the bicycle frame 2 and the seat post 9 are designed as an integrated seat post (ISP), the seat post 9 is longer in a way that it abuts against the side plate 12. Thus, the side plate 12 further includes a side opening 121 that allows the seat post 9 to pass through, so as to increase boxing convenience for the bicycle frame 2 and to reduce the possibility of damaging the side plate 12 as the seat post 9 abuts against the side plate 12 over an extended period of time.

In conclusion, the present invention provides following features.

1. The exhibition box may be drawn out using the handle member, and exhibition and sales may be directly conducted through the exhibition opening without involving an additional assembly process for exhibition. Thus, post-exhibition disassembling complications as well as time and effort are reduced, and packaging quality is enhanced at the same time.

2. With the at least one fixing member, the fixing holes and the crank fixing hole, the bicycle frame may be secured to prevent the bicycle frame from sliding and thus from being scratched during the transportation process.

3. With the positioning opening, the wheel axis of the first wheel may be fastened thereon to prevent sliding during the transportation process.

4. Using the wheel positioning member and the protective separating member, the first wheel and the second wheel are protected and fixed to prevent impacts during the transportation process.

5. With the upper fork accommodating portion formed, the boxing volume can be reduced.

6. To carry outdoors, the bicycle frame is placed back into the exhibition box, and the first wheel and the second wheel that are already packaged are together place into the outer box. Thus, the object of recycling is achieved to reduce costs and burden on the environment.

7. The seat post is allowed to pass through the side opening provided, so as to increase boxing convenience for the bicycle frame and to minimize the possibility of damages caused by the seat post that abuts against the side plate over an extended period of time.

What is claimed is:

1. A bicycle packaging structure for a bicycle, the bicycle comprising a first wheel as a rear wheel of the bicycle, a second wheel as a front wheel of the bicycle and a bicycle frame, each of the first wheel and the second wheel comprising a wheel axis, wherein the first wheel comprises a transmission gear assembly that is coaxial as the wheel axis, and the bicycle frame comprises an upper fork, a crank, a seat post and a front fork which comprises a vertical bar, the bicycle packaging structure comprising:

an exhibition box, comprising a lower plate, a side plate surrounding the lower plate, an accommodating space formed by the lower plate and the side plate, and an exhibition opening at one side of the side plate away from the lower plate, the accommodating space disposed for accommodating the bicycle frame, the lower plate comprising a plurality of fixing holes and a positioning opening corresponding to a position of the wheel axis of the first wheel, wherein the positioning opening is disposed for positioning the wheel axis of the first wheel;

at least one fixing member, disposed for mounting the bicycle frame on the lower plate through the plurality of fixing holes; and a wheel positioning member disposed at one side of the lower plate away from the accommodating space, wherein the wheel positioning member comprises a protection body that secures the first wheel and a first through hole for the wheel axis of the first wheel to pass through.

2. The bicycle packaging structure of claim 1, wherein the bicycle frame and a seat post are designed as an integrated seat post (ISP), and the side plate further comprises a side opening that allows the seat post of the bicycle frame to pass through.

3. The bicycle packaging structure of claim 1, wherein one side of the lower plate away from the accommodating space is provided for the first wheel to be disposed.

4. The bicycle packaging structure of claim 1, wherein the positioning opening is disposed for positioning the transmission gear assembly.

5. The bicycle packaging structure of claim 4, wherein the positioning opening is disposed for the transmission gear assembly penetrating the positioning opening and positioned in the accommodating space.

6. The bicycle packaging structure of claim 1, further comprising a protective separating member installed with the second wheel, the protective separating member is disposed adjacent to the exhibition opening and comprises a protective partitioning plate placed between the second wheel and the bicycle frame and a fastening portion that fastens the second wheel to the protective partitioning plate.

7. The bicycle packaging structure of claim 6, wherein the protective partitioning plate comprises a second through hole that allows the wheel axis of the second wheel to pass through, and a fastening hole, wherein the fastening portion fixes the second wheel on the protective partitioning plate away from the bicycle frame through the fastening hole.

8. The bicycle packaging structure of claim 1, wherein the lower plate further comprises an upper fork accommodating portion corresponding to a position of the upper fork.

9. The bicycle packaging structure of claim 8, wherein the lower plate further comprises a first cut section and a second cut section that meets and forms an included angle with the first cut section, the upper fork accommodating portion is formed correspondingly to a shape of the upper fork and disposed for the upper fork passing through the lower plate via the upper fork accommodating portion.

10. The bicycle packaging structure of claim 1, wherein the lower plate further comprises a crank fixing hole for penetrating and fixing the crank.

11. The bicycle packaging structure of claim 1, wherein the lower plate is disposed for securing the seat post by penetrating the at least one fixing member through the plurality of fixing holes.

12. The bicycle packaging structure of claim 1, wherein the side plate comprises a handle member for carrying.

13. The bicycle packaging structure of claim 1, wherein the at least one fixing member penetrates through the plurality of fixing holes to secure the front fork at the lower plate.

* * * * *